US005344327A

United States Patent [19]

Brunker et al.

[11] Patent Number: 5,344,327

[45] Date of Patent: Sep. 6, 1994

[54] ELECTRICAL CONNECTORS

[75] Inventors: David L. Brunker, Naperville; Richard A. Nelson, Glen Ellyn, both of Ill.

[73] Assignee: Molex Incorporated, Lisle, Ill.

[21] Appl. No.: 96,114

[22] Filed: Jul. 22, 1993

[51] Int. Cl.[5] ..... H01R 4/66

[52] U.S. Cl. ..... 439/108; 439/609

[58] Field of Search ..... 439/108, 608, 609, 620

[56] References Cited

U.S. PATENT DOCUMENTS 4,707,039 11/1987 Whipple ..... 439/75
5,040,998 8/1991 Suzuki et al. ..... 439/108 X
5,046,960 9/1991 Fedder ..... 439/108

*Primary Examiner*—Eugene F. Desmond

*Attorney, Agent, or Firm*—Charles S. Cohen

[57] ABSTRACT

A shielded electrical connector is disclosed for mating with a complementary electrical connector. The shielded connector includes a dielectric housing. A first region of the housing has a plurality of first terminals mounted therein in a first given array for interconnection with a plurality of first terminals of the complementary connector. A second region of the housing has a plurality of second terminals mounted therein in a second given array for interconnection with a plurality of second terminals of the complementary connector. An air gap is provided in the dielectric housing between the first and second arrays of terminals to form a barrier to reduce the capacitive coupling and crosstalk between the terminals in the first and second arrays thereof.

10 Claims, 2 Drawing Sheets

ELECTRICAL CONNECTORS

FIELD OF THE INVENTION

This invention generally relates to the art of electrical connectors and, particularly, to a hybrid electrical connector for accommodating both high frequency transmissions as well as lower frequency transmissions.

BACKGROUND OF THE INVENTION

Electrical connectors are used to interconnect signal transmission lines to printed circuit boards, other electronic devices or to other complementary connectors. The transmission lines transmit signals through a plurality of conductors which, preferably, are physically separated and electromagnetically isolated along their length.

In the electronics industry, particularly the computer industry, the predominant system embodies a plurality of plug-in type connectors in mating engagement with receptacle connectors on the computer, its main printed circuit board or other electronic devices. The transmission lines typically include coaxial electrical cables, either in round or flat form, and round cables are presently being used predominantly in relatively high frequency applications between various system components.

Classical coaxial designs derive their characteristic impedance from the geometrical relationship between the inner signal conductors and the outer shield member and the intervening dielectric constant. For a given impedance, signal conductor size and dielectric material, an overall outside dimension is defined. In order to increase signal density and reduce the overall outside dimensions of a transmission line connector system, alternate geometries and/or dielectric materials are required.

For data processing purposes, cables usually utilize twisted pairs of conductors to achieve the necessary characteristics, particularly impedance control and cross talk control. Coaxial cables are frequently used in singular, isolated, conductor configurations in high frequency applications, such as to a high-speed, high-resolution video monitor for the transmission of red, green and blue video signals. Most often, the lower speed data transmission lines are separated from the high speed signal transmission lines. Consequently, different electrical connectors are often used for the lower speed data transmission lines than for the high speed signal lines. This adds to the problem of requiring multiple connectors in ever-increasing miniaturized and high density applications.

In order to solve such problems as identified immediately above, an improved electrical connector was designed as shown in U.S. Pat. No. 5,102,353 to Brunker et al, dated Apr. 7, 1992 and assigned to the assignee of this invention. That patent shows an electrical connector which terminates both high speed signal transmission lines and the slower data transmission lines in a unique manner providing a common ground system for all of the high frequency conductors to reduce the number of interconnections predominant in the prior art and to increase signal contact density while maintaining a desired impedance level.

The present invention is directed to further improvements in electrical connectors of the character described above and of the type shown in the U.S. Pat. No. 5,102,353 patent. In particular, this invention is directed to reducing capacitive coupling and crosstalk between the arrays of high speed signal terminals and lower speed data terminals of the high and low speed transmission lines.

SUMMARY OF THE INVENTION

An object, therefore, of the invention is to provide a new and improved electrical connector for interconnecting signal transmission lines in electronic devices such as computers or the like.

In the exemplary embodiment of the invention, an electrical connector is provided as an interface between a plurality of transmission lines and an electronic device such as a printed circuit board of the device. The connector is a shielded electrical connector for mating with another electrical connector along a mating axis, and the shielded connector includes an elongated dielectric housing having a mating face generally perpendicular to the mating axis. An outer conductive shield member generally surrounds a portion of the dielectric housing for mating with the another electrical connector.

A first region of the dielectric housing has a plurality of lower speed data terminals mounted therein of a first given array for interconnection with a plurality of first terminals of the another connector. A second region of the housing has a plurality of high speed signal terminals mounted therein of a second given array for interconnection with a plurality of second terminals of the another connector. The first given array of terminals are spaced from the second given array of terminals longitudinally of the housing.

The invention contemplates providing an opening or air gap in the dielectric housing between the first and second arrays of terminals. The air gap defines an air reservoir to reduce the capacitive coupling and crosstalk between the high speed signal terminals and the lower speed data terminals. In essence, the air gap establishes a discontinuous dielectric condition within the insulative housing in the form of an air pocket devoid of plastic material. This air pocket establishes a region of reduced electric permittivity, compared to the general housing material, thereby reducing capacitive coupling between 10 electrical conductors separated by and on opposing sides of the air pocket barrier. This reduced capacitive coupling will reduce electrical field coupling of the conductive elements distributed across the air pocket barrier thereby reducing cross-talk.

As shown herein, the air gap is provided by a slot extending transversely of the elongated housing between the two arrays of terminals. The slot is of a generally uniform width and extends into the mating face of the dielectric housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
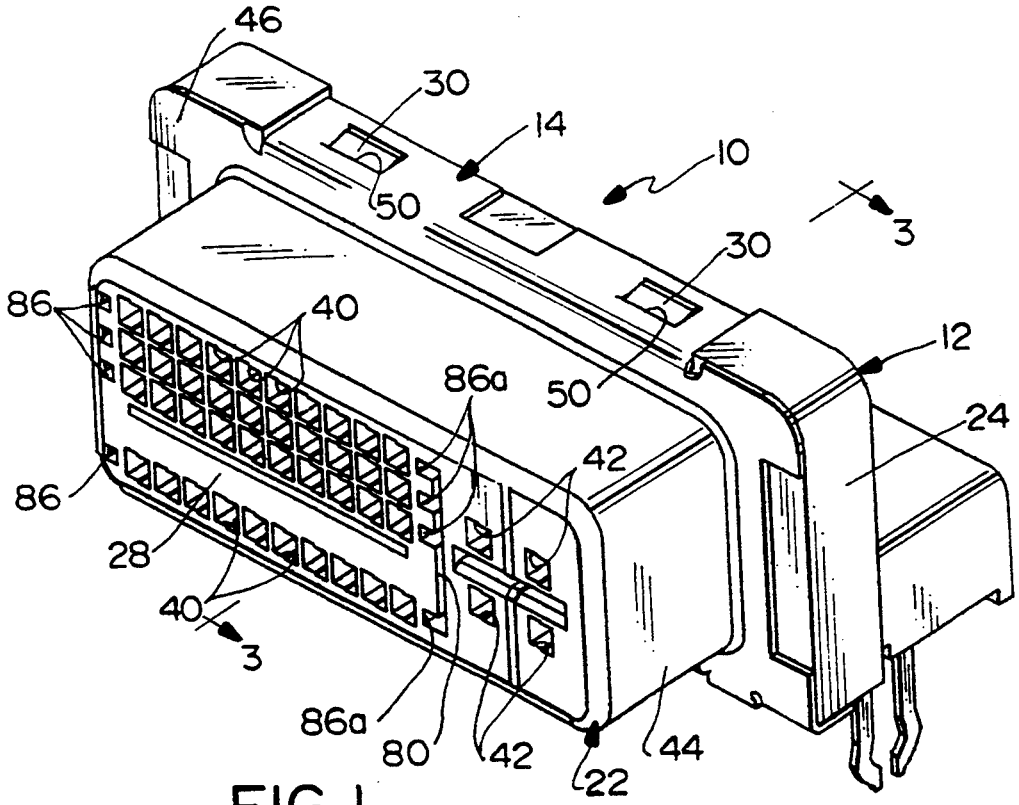
FIG. 1 is a perspective view of the front or mating side of an electrical connector embodying the concepts of the invention.
Figure 2:
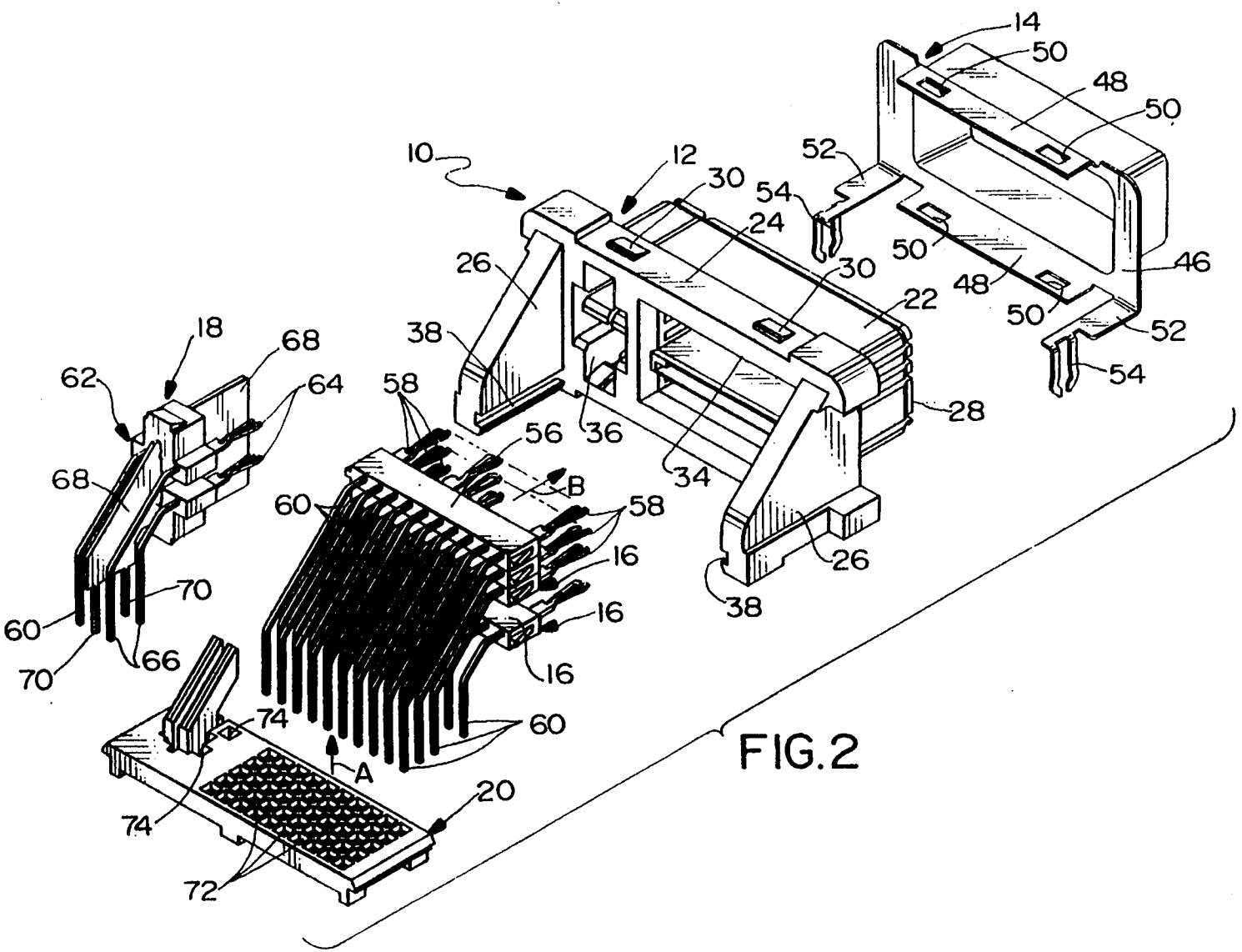
FIG. 2 is an exploded perspective view looking toward the rear side of the connector.

Referring to the drawings in greater detail, and first to FIGS. 1 and 2, the invention is embodied in a hybrid electrical connector, generally designated 10, for terminating both the conductors of slower data transmission lines and the conductors of high speed or high frequency transmission lines. More particularly, electrical connector 10 includes a dielectric housing, generally designated 12, a conductive shield, generally designated 14, data transmission terminal modules, generally designated 16 (FIG. 2), a high speed signal transmission terminal module, generally designated 18, and a tail aligning device, generally designated 20. The overall configuration of dielectric housing 12 and conductive shield 14 define a generally rectangular electrical connector.

Dielectric housing 12 includes a forwardly directed, generally rectangular mating portion 22 projecting forwardly from an enlarged, transversely outwardly projecting flange portion 24 as best seen in FIG. 2. A pair of triangulated side wings 26 project rearwardly from opposite sides of flange portion 24. Mating portion 22 defines a mating face 28 as best seen in FIG. 1. The housing is unitarily molded of dielectric material such as plastic or the like, and a pair of ramped latch bosses 30 are molded integral with and project outwardly from both the top and bottom of flange portion 24 as seen in FIG. 2, for latching interengagement with conductive shield 14 as described hereinafter. As seen in FIG. 2, the rear of dielectric housing 12 includes a receptacle area 34 for receiving data transmission terminal modules 16, and an opening 36 for receiving high speed signal transmission terminal module 18. Grooves 38 are formed on the inside of side wings 26 for slidingly receiving tail aligning device 20. Lastly, as seen in FIG. 1, the front face 28 of mating portion 22 of the dielectric housing has a first array of passages 40 for receiving a plurality of lower speed data contacts or terminals from the complementary mating connector, and a second array of passages 42 for receiving a plurality of high speed signal contacts or terminals of the complementary connector.

Conductive shield 14 has a forwardly projecting, generally rectangularly shaped shroud portion 44 for surrounding mating portion 22 of dielectric housing 12, along with a peripheral face plate portion 46 for substantially covering the front surface of flange portion 24 of the housing. The shield has a pair of rearwardly projecting flanges 48, each flange having a pair of latch apertures 50 formed therein. A pair of legs 52 project rearwardly from opposite sides of peripheral face plate portion 46, each leg terminating in a bifurcated boardlock 54 which is insertable into an appropriate mounting hole in a printed circuit board and for interconnection with a ground circuit on the board or in the hole. The conductive shield is fabricated of stamped and formed sheet metal and is assembled to dielectric housing 12 as shown in FIG. 1, whereupon ramped latch bosses 30 snap into latching engagement within latch apertures 50 of the shield.

High speed signal transmission terminal modules 16 have elongated dielectric blocks 56 within which a plurality of data transmission terminals are insert molded. The data transmission terminals include contact or terminal portions 58 (FIG. 2) which project into the first array of passages 40 (FIG. 1). The data transmission terminals have tail portions 60 projecting from the rear of blocks 56 and angled downwardly at a right-angle to a mating axis of the connector perpendicular to mating face 28.

Generally, high speed signal transmission terminal module 18 includes a modular block construction, generally designated 62, for mounting a plurality of high speed signal terminals each having a forwardly projecting contact or terminal portion 64 (FIG. 2) projecting into a respective one of the second array of passages 42 (FIG. 1) in mating face 28 of the dielectric housing. The high speed signal transmission terminals have tail portions 66 projecting rearwardly and downwardly at a right-angle to the mating axis of the connector. As will be described in greater detail hereinafter, high speed signal transmission terminal module 18 includes a ground plate 68 located between two pairs of terminal tails 66 of the signal transmission terminal module. The ground plate, itself, has tails 70 projecting downwardly therefrom.

Tails 60 of the terminals of data transmission modules 16, tails 66 of the signal terminals of high speed signal transmission terminal module 18 and tails 70 of ground plate 68 all are adapted for insertion into appropriate holes in a printed circuit board for solder connection to circuit traces on the board or in the holes. Therefore, tail aligning device 20 includes a first array of apertures 72 for receiving tails 60 of the data transmission terminals and a second array of apertures 74 for receiving tails 66 of the terminals of high speed signal transmission terminal block 18.

In assembly, tail aligning device 20 is assembled to terminal modules 16 and 18 by insertion of the tails of the terminals into apertures 72,74 as described above, and as indicated by arrow "A" in FIG. 2. This subassembly then is assembled to dielectric housing 12 in the direction of arrow "B" by inserting data transmission terminal modules 16 into receptacle area 34 and high speed signal transmission terminal module 18 into opening 36, as tail aligning device 20 slides within grooves 38 of the dielectric housing.

Figure 3:
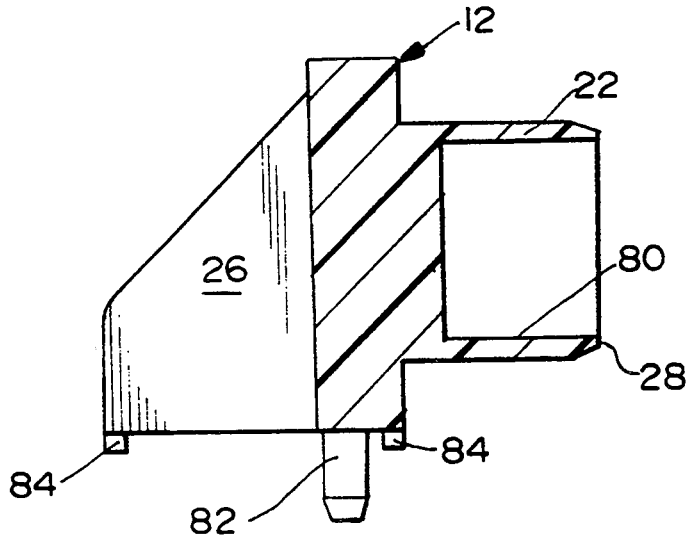
FIG. 3 is a vertical section through the dielectric housing of the connector, taken generally along line 3—3 of FIG. 1.

Referring to FIG. 3 in conjunction with FIG. 1, generally the invention is directed to means for modifying the dielectric constant of dielectric housing 12 to reduce the capacitive coupling and crosstalk between the high speed signal terminals of high speed signal transmission terminal module 18 and the lower speed data terminals of data transmission terminal module 16. More particularly, as described above, passages 40 in mating face 28 (FIG. 1) of the dielectric housing define a first given array of the lower speed data terminals, and passages 42 define a second given array of the high speed signal terminals. It can be seen in FIG. 1 that the first given array of terminals defined by passages 40 is spaced longitudinally of the second given array of terminals defined by passages 42. The invention contemplates that a slot or opening 80 be formed or molded in dielectric housing 12 between the two arrays of terminals. In the preferred embodiment of the invention, the slot is located in forwardly projecting mating portion 22 of the housing as best seen in FIG. 3. In other words, this location is between the interconnections of the contact or terminal portions 58 and 62 (FIG. 2) of the terminals and the contacts or terminals of the complementary mating connector. The slot extends transversely across the mating portion 22 of the housing, inwardly from mating face 28 and is of a generally uniform width.

Slot 80 forms an air gap or air reservoir to reduce the capacitive coupling and crosstalk between the high speed signal terminals and the lower speed data terminals. In essence, the air gap forms a discontinuity in the dielectric material of the housing thus reducing the dielectric constant of the region and therefore the capacitive coupling of the conductive terminals positioned across the air gap. This reduces the cross-talk between the terminals in the first and second arrays of terminals.

Lastly, FIG. 3 shows that dielectric housing 12 includes at least one mounting peg 82 for mounting within an appropriate mounting hole in the printed circuit board, along with a plurality of downwardly projecting standoffs 84 for spacing the housing/connector from the board. Partitions 85 project upwardly from tail aligning device 20 on opposite sides of ground plate 68, between the ground plate and terminal tails 66. In addition, FIG. 1 shows that a plurality of holes 86, including holes **86*a* in communication with slot 80, project inwardly of mating face 28** of the housing. These holes simply are core-out holes used to facilitate molding the unitary housing.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a generally rectangular, shielded electrical connector for mating with another electrical connector along a mating axis, the shielded connector including an elongated dielectric housing having a mating face generally perpendicular to said mating axis, an outer conductive shield member generally surrounding a portion of the housing for mating with the another electrical connector, a first region of the housing having mounted therein a plurality of lower speed data terminals of a first given array for interconnection with a plurality of first terminals of the another connector, and a second region of the housing having mounted therein a plurality of high speed signal terminals of a second given array for interconnection with a plurality of second terminals of the another connector, the first given array of terminals being spaced from the second given array of terminals longitudinally of the housing, wherein the improvement comprises:

an opening in the dielectric housing between the first and second arrays of terminals to define an air reservoir to reduce the capacitive coupling and crosstalk between the high speed signal terminals and the lower speed data terminals.

2. In a generally rectangular, shielded electrical connector as set forth in claim 1, wherein said opening comprises a slot extending transversely across the elongated housing.

3. In a generally rectangular, shielded electrical connector as set forth in claim 2, wherein said slot is of a generally uniform width.

4. In a generally rectangular, shielded electrical connector as set forth in claim 2, wherein said slot extends into the mating face of the housing.

5. In a shielded electrical connector for mating with another electrical connector along a mating axis, the shielded connector including a dielectric housing, an outer conductive shield member generally surrounding a portion of the housing for mating with the another electrical connector, a first region of the housing having mounted therein a plurality of first terminals in a first given array for electrical connection with a plurality of first terminals of the another connector, and a second region of the housing having mounted therein a plurality of second terminals in a second given array for interconnection with a plurality of second terminals of the another connector, wherein the improvement comprises:

an opening in the dielectric housing between the first and second arrays of terminals to define an air reservoir to reduce the capacitive coupling and crosstalk between the terminals in the first and second arrays thereof.

6. In a shielded electrical connector as set forth in claim 5, wherein said opening comprises a slot extending transversely between the two arrays of terminals.

7. In a shielded electrical connector as set forth in claim 5, wherein said slot is of a generally uniform width and extends into the housing from a mating face thereof.

8. In an electrical connector for mating with another electrical connector, including a dielectric housing, a first region of the housing having mounted therein a plurality of first terminals in a first given array for interconnection with a plurality of first terminals of the another connector, and a second region of the housing having mounted therein a plurality of second terminals in a second given array for interconnection with a plurality of second terminals of the another connector, wherein the improvement comprises:

an air gap in the dielectric housing between said first and second arrays of terminals to establish a region of reduced electric permittivity in order to reduce crosstalk between the terminals in the first and second arrays thereof.

9. In an electrical connector as set forth in claim 8, wherein said dielectric housing is molded of plastic material and said air gap comprises a slot molded into the housing.

10. In an electrical connector as set forth in claim 8, wherein said dielectric housing has a forwardly projecting mating portion within which contact portions of said terminals are disposed, and said air gap is located in said mating portion of the housing.

* * * * *